United States Patent [19]

Bouffard et al.

[11] Patent Number: 4,550,558

[45] Date of Patent: Nov. 5, 1985

[54] CRADLE FOR A TWISTING MACHINE

[75] Inventors: Jean Bouffard, Lachine; André Dumoulin, Montagnes; Edgar K. Lederhose, Chateauguay, all of Canada

[73] Assignee: Northern Telecom Limited, Montreal, Canada

[21] Appl. No.: 565,743

[22] Filed: Dec. 27, 1983

[51] Int. Cl.[4] ..... B65H 59/04; D01H 7/44; D01H 7/86

[52] U.S. Cl. ..... 57/58.52; 57/59; 57/113; 242/68.3; 242/75.4; 242/156.2

[58] Field of Search ..... 57/59–65, 57/58.52, 58.57, 58.68, 66.5, 113, 127.5, 127.7, 138; 242/129.8, 129.7, 129.71, 68.3, 156, 156.2, 75.4, 75.43

[56] References Cited

U.S. PATENT DOCUMENTS

| | | | |
|---|---|---|---|
| 1,659,259 | 2/1928 | Grout | 242/156.2 |
| 2,419,808 | 4/1947 | Wirth | 242/156.2 |
| 3,013,378 | 12/1961 | Newton | 57/59 X |
| 3,109,605 | 11/1963 | Ostermann | 242/129.8 |
| 3,540,675 | 11/1970 | Goldsworthy | 242/156.2 |
| 4,375,875 | 3/1983 | Richardson | 57/127.5 X |
| 4,423,588 | 1/1984 | Garcia | 57/84 |

FOREIGN PATENT DOCUMENTS

| | | | |
|---|---|---|---|
| 678401 | 6/1939 | Fed. Rep. of Germany | 57/59 |
| 751626 | 9/1933 | France | 57/59 |

*Primary Examiner*—Stuart S. Levy
*Assistant Examiner*—Joseph J. Hail, III
*Attorney, Agent, or Firm*—R. J. Austin

[57] ABSTRACT

Cradle for a twisting machine with a reel spindle and friction engaging means to engage a reel mounted upon the spindle. The friction engaging means faces the free end of the spindle and is movable axially away from the free end against a resilient means. A means is provided to urge the reel against the engaging means. In a practical structure, the friction engaging means is annular.

6 Claims, 6 Drawing Figures

CRADLE FOR A TWISTING MACHINE

This invention relates to cradles for twisting machines.

In conventional twisting machines for twisting together twisted units (normally pairs) of insulated conductor for telecommunications cable, reels of individually insulated conductors are rotatably held in cradles in the machine and the individual conductors are drawn from the reels. It is conventional to mount each reel upon a rotatable horizontal spindle and it is held so as to rotate with the spindle by virtue of reception of a hole on the reel around a closely fitting location spigot in a vertical backplate connected to the spindle. Rotation of the reel then takes place by virtue of rotation of the spindle and backplate upon a support of the cradle. This method of mounting reels upon cradles creates difficulties. Firstly, there is a problem concerned with reception of the spigot accurately within the hole, because the location of the reel upon the spindle during reel mounting obscures both the spigot and hole from the machine operator. It is necessary to rotate the reel upon the spindle to achieve accurate alignment of the spigot with the hole and this may be difficult in view of the obscuration. Secondly, and because of the obscuration, the operator is likely to mistakenly believe that the reel has been correctly mounted in position. A reel lock is provided upon the free end of the spindle to lock the reel against the backplate. It is not unknown for a situation to arise in which the reel lock appears to hold to reel correctly upon the spindle and in which the reel is not fully held against the backplate with the spigot received in the hole. In such circumstances, the reel may be axially displaced along the spindle and interfere with the rotation of a flyer around the cradle. If this occurs, substantial damage to the cradle, flyer and other parts of the twisting machine can result.

It would be an advantage, therefore, if a cradle could be provided for mounting a reel in a relatively simple manner to achieve accurate location of the reel upon the spindle, so as to avoid or minimize the above problems.

Accordingly, the present invention provides a cradle for a twisting machine comprising a reel spindle for supporting a reel of filamentary material in a reel support position upon the spindle, the spindle rotatably mounted upon a support and having a free end, an annular braking member surrounding and secured to the spindle, means to apply a braking force to the braking member and thus to the spindle, friction engaging means rotatable together with and about the axis of the spindle, for frictional engagement with the reel, said engaging means having a friction surface facing towards the free end of the spindle, and resiliently compressive means to urge the friction surface towards the free end of the spindle, and means for urging a reel when mounted upon the spindle against the friction surface and to urge the friction engaging means against the resiliently compressive means to positively drivably couple the reel with the spindle and the braking member.

In a preferred arrangement, the friction engaging means is annular, although friction engaging pads spaced around the spindle will suffice. Conveniently the friction engaging means is resiliently mounted for axial movement towards the free end of the spindle upon a rotatable brake member, which is secured for rotation with the spindle.

One embodiment of the invention will now be described by way of example, with reference to the accompanying drawings in which.

Figure 1:
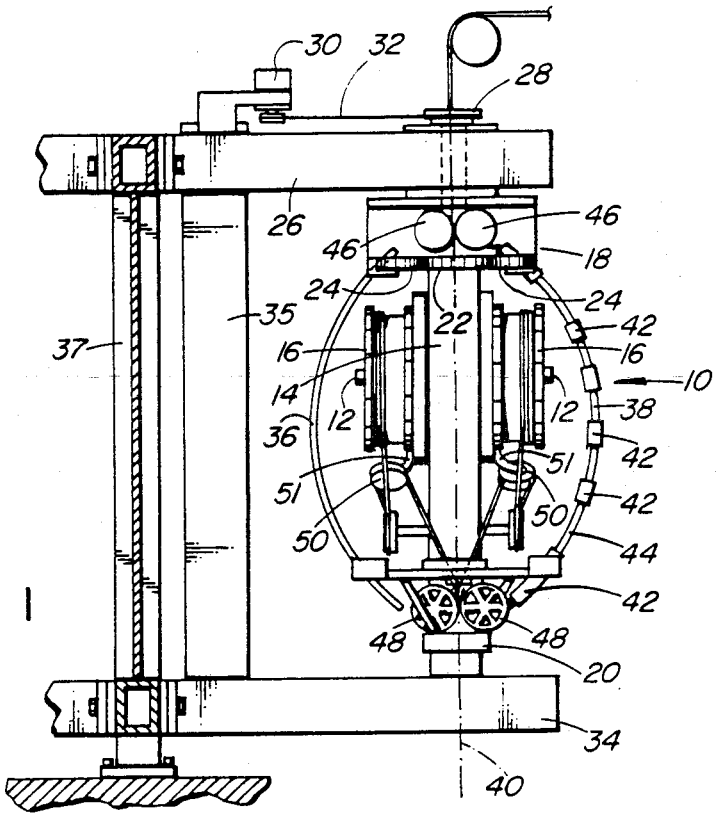
FIG. 1 is a side elevational view of part of a twisting machine showing the cradle assembly.

As shown in FIG. 1, a twisting machine comprises a cradle 10 having two horizontal spindles 12 extending in opposite directions from a vertical support pedestal 14. The spindles are for holding reels 16 of insulated telecommunications conductor, which are to be formed into twisted pairs. In known manner the cradle 10 is held at top and bottom ends by bearings (not shown) within rotatable structures 18 and 20. In known fashion, the top end of the cradle is provided with a sun gear 22 around which planet gears 24 rotate, the planet gears being mounted upon the top vertical structure 18. The structure 18 is rotatably held within a horizontal frame member 26 and extends upwardly from this to be provided with a drive pulley 28, which is connected by a pulley belt 32 to an electrical drive motor 30 carried by the structure 26. The lower rotatable structure 20 is carried in bearings within a lower horizontal frame member 34. This construction which includes the horizontal frame members 26 and 34 is a unitary construction including a vertical frame member 35 and which is completely detachable as an assembly from a vertical main frame 37. The main frame carries a plurality of identical frames 26, 34, 35 and twisting machines according to this embodiment. This whole arrangement is described in greater detail in copending patent application Ser. No. 565,760, entitled "Apparatus For Twisting Insulated Conductors" and filed concurrently herewith in the names of J. Bouffard, A. Dumoulin and O. Axiuk.

As shown by FIG. 1, the twisting machine comprises two flyers 36 and 38. The flyer 36 extends the complete length of the cradle and is of arcuate configuration so as to lie outwardly from the cradle with its upper and lower ends secured to the rotatable structures 18 and 20, and directed towards the rotational axis 40 of the cradle. The flyer 36 is of conventional tubular construction for accommodating pulp insulated conductors passing through the tube during twisting. The flyer 38 comprises a plurality of spaced annular members which are short tubes or rings 42 through the centre of which is defined a feedpath for the conductors removed from spools 16. The tubes or rings 42 are secured to a holding member 44 of the flyer 38, the member 44 being a rigid bar or tube secured at its top and bottom ends to the structures 18 and 20. The flyers 36 and 38 are rotated in diametrically opposed positions around the vertical axis 40, as is more fully described in copending patent application Ser. No. 565,635, entitled "Twisting Machine" and filed concurrently herewith in the names of J. Bouffard, A. Dumoulin and O. Axiuk. As described in that application, the two flyers and associated pulleys provide a balanced rotational structure while avoiding conventional balancing masses. Aligned with the top and bottom ends of each flyer are the two associated pulleys 46 and 48.

Figure 2:
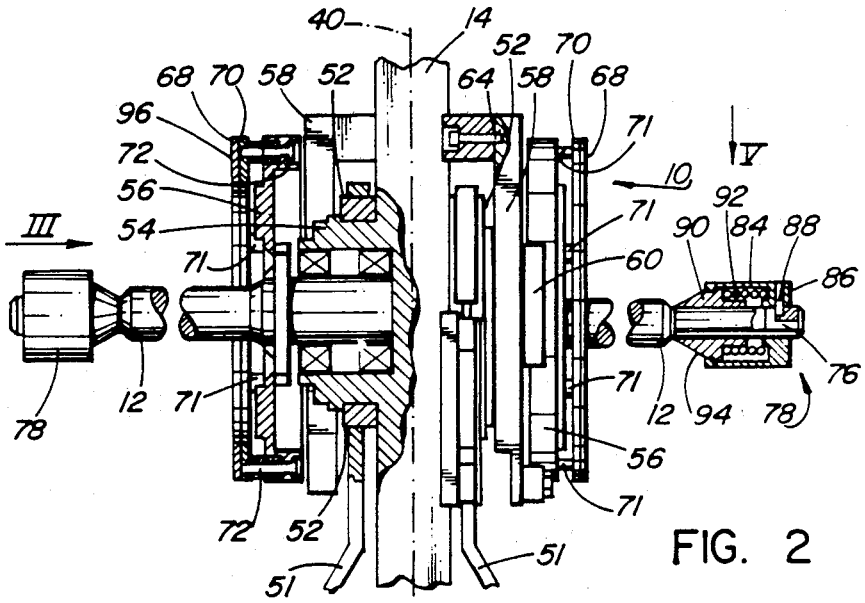
FIG. 2 is a view partly in section of part of the cradle assembly shown in FIG. 1 and on a larger scale.
Figure 3:
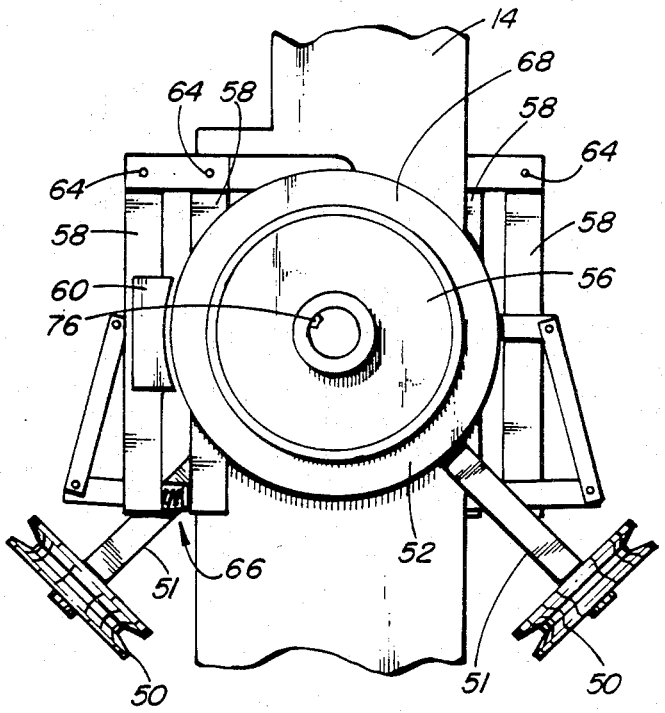
FIG. 3 is a view in the direction of arrow III in FIG. 2.

As shown by FIGS. 2 and 3, each spindle 12 is provided with a tensioning means for controlling the tension in insulated conductor being drawn from a reel 16 carried by the spindle. As is described more fully in a copending patent application Ser. No. 565,761 now U.S. Pat. No. 4,523,423, entitled "Cradle For Twisting Machine" and filed concurrently herewith in the name of J. Bouffard, A. Dumoulin and E. K. Lederhose, each tensioning means comprises a dancing pulley 50 which is connected by an arm 51 to an annulus 52 (FIG. 2). The annulus is rotatably mounted around a structure 54 secured to the pedestal 14, the structure 54 rotatably carrying the spindle 12. As is described in the copending application Ser. No. 565,761 now U.S. Pat. No. 4,523,423, each tensioning device also includes a braking means comprising two arms 58 carrying brake shoes 60 which engage with the inner and outer surfaces of a brake drum 56. One only of the brake shoes 60 may be seen in the Figures. Each arm is pivotally mounted at its upper end 64 and as described in the aforementioned application, a linkage 66 is provided at the lower end and connecting the two arms for operation of the braking means.

Figure 4:
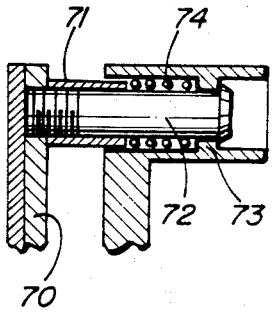
FIG. 4 is a detail of part of FIG. 2 and on larger scale.

The invention is concerned with holding a reel 16 correctly on each of the spindles 12. As shown in FIGS. 2, 3 and 4, this means comprises a friction engaging means which is rotatable about the axis of and together with each spindle 12. This friction engaging means comprises an annular and planar reel engaging member 68 formed from a neoprene rubber with a Shore Hardness of 35. The member 68 is secured to an annular backing plate 70 and this backing plate is attached to the brake drum 56 by means of pins 72 spaced around radially outer regions of the brake drum. The pins 72 pass through sleeves 71 which are attached to the plate 70 and slidably received within holes in the brake drum. Springs 74 lying between the sleeves and abutments 73 in the holes urge the pins and thus the assembly of the member 68 and the back plate 70 in an axial direction towards the free end of the spindle 12.

Figure 5:
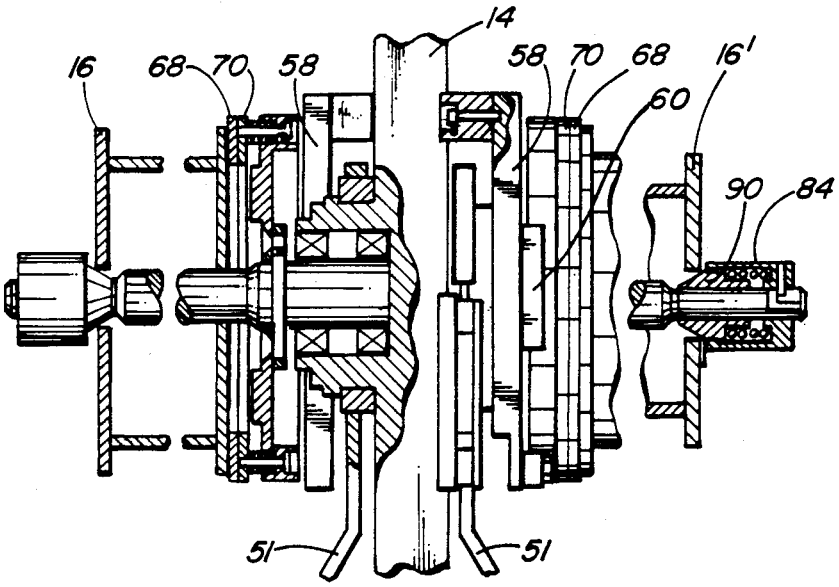
FIG. 5 is a view similar to FIG. 2 showing a reel mounted in position.
Figure 6:
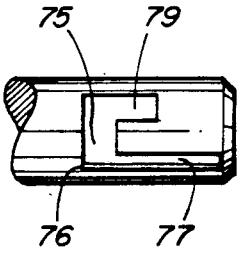
FIG. 6 is a view in the direction of arrow V in FIG. 2 and illustrating, to a larger scale, a locking mechanism for a reel lock for the reel.

The free end of the spindle is provided with a 'U' shaped groove 76 (FIG. 6) and a reel lock 78 (FIGS. 2 and 5) is provided for assembly onto the end of the spindle for holding the reel correctly in position. As shown, the groove 76 has a base portion 75 extending circumferentially of the spindle, and two parallel legs 77 and 79, one of which opens at the free end of the spindle. The other leg 79 is blind and terminates short of the free end. The reel lock 78 is formed in two main parts. An outer part 84 is of cylindrical form and has an inwardly projecting end section 86 provided with a location spigot 88 for sliding reception within the groove 76. The other main portion 90 is slidable within the cylindrical portion 84 and is urged towards the opposite end of the cylindrical portion from the end section 86 by a compression spring 92. This spring holds abutment sections of the two portions 84 and 90 against each other in a normal condition. The portion 90 has a frustoconcial section 94 which, in the normal condition, extends beyond the cylindrical portion 84.

In use of the cradle, before assembly of each reel onto its spindle 12, the position of each member 68 and its backing plate 70 is as shown in FIG. 2, i.e. spaced away from the brake drum by the springs 74. To assemble a reel 16 onto its spindle, the appropriate reel lock 78 is removed and the reel is placed over the spindle and moved manually against the friction engaging surface 96 of the member 68, i.e. that surface facing towards the free end of the spindle. The reel lock is then placed in position on the end of the spindle by locating the lock with the frustoconical portion leading onto the spindle and then engaging the location spigot 88 into the open end of the groove 76. The reel lock is then forced along the groove so as to engage the reel and force it against the member 68 thereby compressing the springs 74. This causes the member 68 to move axially against the springs towards the brake drum. Some compression of the spring 92 by relative axial movement of the reel lock portions 84 and 90 may take place. Upon the location spigot reaching the base portion 75 of the groove, rotation of the reel lock causes the location spigot to move along the base portion. The spigot is then moved along the blind leg 79 of the groove under the action of spring 92 until the spigot engages the blind end. This is the position of the assembly shown in FIG. 5, as can be seen, the reel lock is held securely in position with the frustoconical member engaging and centralizing the reel. At the other end of the reel, the member 68 and its backplate 70 are held against the brake drum 56 by the force of the spring 92 urging against the portion 90 of the reel lock.

In use, removal of conductor from the reel 16 causes the reel to rotate. The rotational force is transmitted to the brake drum 56 and to the spindle 12 through the member 68 because of the frictional engagement between the side of the reel and the member 68 created by the axial force of the spring 92 in the reel lock. Hence the driving force ensures that the reel and the spindle, together with the brake drum, rotate as a unit. Upon the dancing pulley 50 moving under increased tension to operate the brake of the cradle, the brake operates upon the brake drum to resist the rotational speed of the drum and also effectively reduces the reel speed. Thus the member 68 ensures that the reel does not slip relative to the drum. Instead the two are driven together around the axis of the spindle.

As can be seen from the invention and as described in the embodiment, the present invention avoids the use of a hole on the reel for location around a spigot on the backplate or brake drum. There is no necessity, therefore, for accurate angular positioning of the reel upon the spindle to enable the reel to be secured to the spindle. In contrast with the present invention, the reel may be located in any angular position upon the spindle while ensuring that good frictional contact is achieved and maintained with the friction engaging member, i.e. member 68. The reel lock assists in this action by placing a permanent axial pressure upon the reel which holds it in axial driving face-to-face engagement with the friction engaging member. When the reel lock is disposed correctly in position within the blind leg of the groove 76, the assembly of the reel has been accurately achieved.

Thus the assembly of the reel upon the spindle does not depend upon any particular skill of the operator and the problems previously associated with assembly procedure are avoided.

What is claimed is:

1. A cradle for a twisting machine comprising a reel spindle for supporting a reel of filamentary material in a reel support position upon the spindle, the spindle rotatably mounted upon a support and having a free end, an annular braking member surrounding and secured to the spindle, means to apply a braking force to the braking member and thus to the spindle, friction engaging means rotatable together with and about the axis of the spindle, for frictional engagement with the reel, said friction engaging means having a friction surface facing towards the free end of the spindle, and resiliently compressive means to urge the friction surface towards the free end of the spindle, and means for urging a reel when mounted upon the spindle against the friction surface to urge the friction engaging means against the resiliently compressive means to positively drivably couple the reel with the spindle and the braking member.

2. A cradle according to claim 1 wherein the friction engaging means is annular and surrounds the axis of the spindle.

3. A cradle according to claim 2 wherein the resiliently compressive means comprises a plurality of springs in angularly spaced apart positions of the friction engaging means relative to the spindle axis.

4. A cradle according to claim 3 wherein the friction engaging means is axially movably mounted upon the braking member.

5. A cradle according to claim 4 wherein the friction engaging means comprises a reel engaging member secured to a backing member and said backing member is axially movably mounted on the braking member by means of pins fixed to the backing member and slidably received by holes in the braking member.

6. A cradle according to claim 1, wherein the means for urging the reel against the friction surface comprises an annular locking member having two axially movable portions and a spring means normally holding said portions to define a maximum axial length for the locking member which also has an inwardly directed location element, and the spindle has a surface groove for reception of the location element, the groove having an opening at the free end of the spindle and a blind end portion which extends towards the free end to terminate at the blind end short of the free end, disposition of the location element within the blind end portion and at the blind end of the groove causing the spring means to apply an axial force through the axially movable portions to urge the reel against the friction surface.

* * * * *